US006943661B2

(12) United States Patent
Janicek et al.

(10) Patent No.: US 6,943,661 B2
(45) Date of Patent: Sep. 13, 2005

(54) QUICK-CONNECT POSITIVE TEMPERATURE COEFFICIENT OF RESISTANCE RESISTOR/OVERLOAD ASSEMBLY AND METHOD

(75) Inventors: Alan J. Janicek, Morrison, IL (US); Kennett R. Fuller, Morrison, IL (US); Mark A. Heflin, Davenport, IA (US); Ted P. Struttmann, Sterling, IL (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/682,765

(22) Filed: Oct. 16, 2001

(65) Prior Publication Data

US 2003/0071713 A1 Apr. 17, 2003

(51) Int. Cl.[7] ..... H01C 13/00

(52) U.S. Cl. ..... 338/220; 338/22 R; 338/221; 338/276; 439/357

(58) Field of Search ..... 338/22 R, 22 SD, 338/220, 221, 276; 439/357, 282; 174/50.2, 50.3

(56) References Cited

U.S. PATENT DOCUMENTS

| | | | |
|---|---|---|---|
| 3,167,736 A | 1/1965 | Temple | |
| 3,914,727 A | 10/1975 | Fabricius | 338/22 R |
| 3,988,709 A | 10/1976 | McKinnon et al. | 338/57 |
| 4,213,112 A | 7/1980 | Alman et al. | 338/183 |

(Continued)

FOREIGN PATENT DOCUMENTS

| | | | |
|---|---|---|---|
| DE | 3311811 A1 | * | 10/1984 |
| EP | 0606752 | * | 7/1994 |
| GB | 2199451 | * | 7/1986 |
| JP | 53-106945 | * | 9/1978 |
| JP | 62-174581 | * | 7/1987 |

*Primary Examiner*—Karl D. Easthom
(74) *Attorney, Agent, or Firm*—Carr LLP

(57) ABSTRACT

A positive temperature coefficient of resistance resistor/overload (PTCR/OL) resistor assembly that can be quickly and easily electrically connected and disconnected from equipment without the need for special tools or equipment. In some arrangements of the present invention, a locking tab on the electrical connector can be secured against an angle on the PTCR/OL to prevent the electrical connection from being broken during shipping or operation equipment movement or vibration. When it is necessary to electrically disconnect the PTCR/OL from the equipment, the locking tab can be disengaged from the angle on the PTCR/OL by bending the tab until it releases from against the angle, and the electrical plug can then be disconnected from the PTCR/OL. The improved assembly provides increased isolation of incoming electrical wires with less material than previous devices. The improved assembly also provides for an easy method of using different terminals in the PTCR/OL, so that a variety of isolated electrical connectors can be utilized with the PTCR/OL with minimal modifications or changes.

12 Claims, 4 Drawing Sheets

U.S. PATENT DOCUMENTS

| | | | | | |
|---|---|---|---|---|---|
| 4,387,412 | A | * | 6/1983 | Woods et al. | 361/27 |
| 4,571,017 | A | * | 2/1986 | Fujita | 439/603 |
| 4,791,272 | A | * | 12/1988 | Thaler et al. | 219/222 |
| 4,925,398 | A | | 5/1990 | Samejima et al. | 439/357 |
| 5,006,950 | A | | 4/1991 | Allina | 361/117 |
| 5,134,888 | A | | 8/1992 | Zylka et al. | 73/726 |
| 5,166,628 | A | | 11/1992 | Henninger | 324/723 |
| 5,314,347 | A | | 5/1994 | Colleran et al. | 439/350 |
| 5,595,497 | A | * | 1/1997 | Wood | 439/282 |
| 5,611,706 | A | * | 3/1997 | Makita et al. | 439/275 |
| 5,617,287 | A | | 4/1997 | Allina | 361/118 |
| 5,718,596 | A | | 2/1998 | Inaba et al. | 439/352 |
| 5,769,650 | A | | 6/1998 | Aoyama et al. | 439/189 |
| 5,945,903 | A | | 8/1999 | Reddy et al. | 337/197 |
| 5,949,324 | A | | 9/1999 | Segler et al. | 338/28 |
| 5,998,763 | A | * | 12/1999 | Mattis et al. | 219/265 |
| 6,074,234 | A | | 6/2000 | Hasegawa | 439/357 |
| 6,126,474 | A | | 10/2000 | Doye et al. | 439/357 |
| 6,132,233 | A | | 10/2000 | Fukuda | 439/357 |
| 6,325,656 | B1 | | 12/2001 | Fukuda et al. | 439/358 |
| 6,361,349 | B1 | | 3/2002 | Hung | 439/357 |
| 6,383,003 | B1 | | 5/2002 | Corona | 439/278 |
| 6,402,943 | B1 | * | 6/2002 | Bohlender | 210/184 |
| 6,459,590 | B2 | | 10/2002 | Malnati | 361/752 |
| 6,558,180 | B2 | * | 5/2003 | Nishimoto | 439/282 |
| 6,659,783 | B2 | * | 12/2003 | Copper et al. | 439/181 |
| 2001/0046803 | A1 | * | 11/2001 | Kodama | 439/357 |

* cited by examiner

QUICK-CONNECT POSITIVE TEMPERATURE COEFFICIENT OF RESISTANCE RESISTOR/OVERLOAD ASSEMBLY AND METHOD

BACKGROUND OF INVENTION

Positive temperature coefficient of resistance resistor/overload (PTCR/OL) assemblies have many uses in industry. The resistance of PTCR/OL assemblies increases with a rise in temperature of the device. Essentially, these assemblies operate normally under normal temperature or electrical current conditions. However, when the ambient temperature in the assemblies or the current flow through the assemblies increases to a level where heat is produced, the resistance of the assemblies increases to limit the flow of current. PTCR/OL assemblies have numerous uses in electronic circuit boards and larger commercial and consumer equipment, such as relays, generators, motors and compressors.

It is desirable to simplify the manufacture of these assemblies and their installation on the equipment of which they comprise a part. Because the equipment in which PTCR/OL assemblies are used is often bulky and heavy, it may be difficult to install the PTCR/OL assembly onto the equipment during manufacture due to size and location restraints. Similarly, removing a failed PTCR/OL assembly and installing a new assembly in situ is often hampered by equipment size and location and the position of the PTCR/OL assembly on the equipment. Thus, the need arose for PTCR/OL assemblies that could be easily installed during equipment manufacture, and easily replaced in situ in the event of a failure.

Because the equipment on which PTCR/OL assemblies are used tend to be subject to vibration, designs have evolved that ensure the assemblies remain securely attached to the equipment, and that connection mechanisms remain securely connected during use, and will not vibrate loose over time. For electrical connections, there is a dual need of making a connection that will remain secure, and keeping electrical connections sufficiently isolated to prevent undesirable contact or short-circuit during operation due to equipment vibration. In order to achieve these operational objectives of ensuring secure connections and proper electrical contact, the electrical connection mechanisms designed are often difficult to install, remove, or reconnect when assembling or replacing the PTCR/OL assembly, and may require the use of special tools.

SUMMARY OF INVENTION

One aspect of the present invention, accordingly, provides a PTCR/OL assembly which has an electrical connection that can be easily connected, disconnected, and reconnected, but which is secure enough to prevent disconnection of the electrical connection from the PTCR/OL assembly due to vibration or movement of the mechanism during operation, and which will keep the electrical connections properly isolated during operation.

Another aspect of the present invention provides a method for electrically connecting a PTCR/OL assembly to the equipment with which it is used. The method includes providing an electrical connection that can be secured on the PTCR/OL assembly during operation to prevent disconnection of the electrical connection during shipping or operation, but which can be disconnected without the need for special tools in order to remove the PTCR/OL when desired.

Another aspect of the present invention provides a PTCR/OL assembly with a PTCR/OL device that has an angle protruding out from the side for use in securing certain types of electrical plugs, the PTCR/OL having at least one male conductive terminal in a socket, each terminal being connected to a terminal plate, and an electrically isolated plug having a female conductive element for connecting to each male conductive terminal on the PTCR/OL, and one female wire receptacle for each female conductive element for connecting a wire capable of conducting electrical current.

Yet another aspect of the present invention provides a method for connecting a PTCR/OL device to electrically conductive wire, the PTCR/OL having an angle protruding outwardly from the body in a plane parallel to the top of the device, adjacent to the at least one socket in the PTCR/OL. A male conductive terminal protrudes into each socket, the terminal connected to a terminal plate in the PTCR/OL. A plug assembly with at least one electrically isolated female conductive element is inserted into the at least one socket on the PTCR/OL such that the at least one female conductive element on the plug assembly is fittingly engaged on the corresponding male conductive terminal in the socket. At least one electrically conductive wire is inserted into each electrically isolated female wire receptacle in the plug to connect the PTCR/OL device.

Additionally, because the PTCR/OL assembly is used with various pieces of equipment that use different types of electrical connectors, another aspect of the present invention is that with only minor modifications which can be made easily during manufacture, it is possible to configure various models of PTCR/OL such that they can be connected to numerous pieces of equipment, making it easier to manufacture a different PTCR/OL for each customer requirement.

BRIEF DESCRIPTION OF DRAWINGS

For a more complete understanding of the present invention, and the advantages thereof, reference is now made to the following descriptions taken in conjunction with the accompanying drawings, in which.

DETAILED DESCRIPTION

Figure 1:
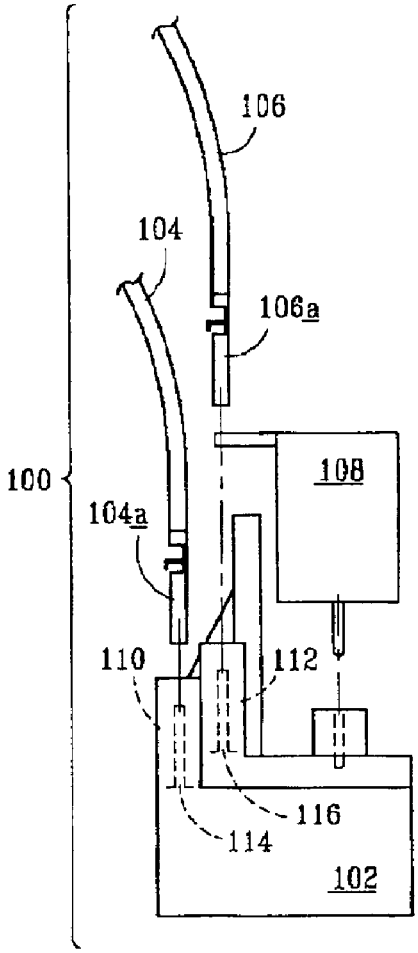
FIG. 1 (PRIOR ART)
FIG. 1 is a partially exploded view of a PTCR/OL assembly embodying features of the prior art.

In the discussion of the FIGURES, the same reference numerals will be used throughout to refer to the same or similar components. In the interest of conciseness, various other components known to the art, such as compressors, generators, relays, and the like on which PCTR/OL assemblies are commonly used, have not been shown or discussed, except insofar as necessary to describe the present invention.

In the following discussion, numerous specific details are set forth to provide a thorough understanding of the present invention. However, it will be obvious to those skilled in the art that the present invention may be practiced without such specific details.

Figure 2:
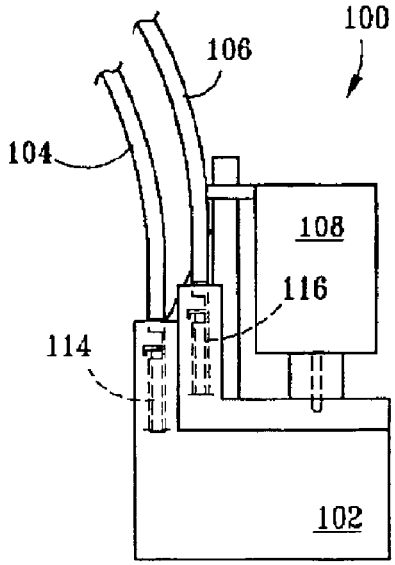
FIG. 2 (PRIOR ART)
FIG. 2 is an assembled view of a PTCR/OL assembly embodying features of the prior art.

Referring to FIGS. 1 and 2 of the drawings, the reference numeral 100 generally designates a PTCR/OL assembly embodying features of the prior art. The PTCR/OL assembly 100 comprises a PTCR/OL 102, a plug-in run capacitor 108, lead wires 104, 106, and locking mechanisms 104*a*, 106*a* on the lead wires 104, 106. The locking mechanisms 104*a*, 106*a*, are required to prevent the lead wires 104, 106 from disconnecting, or vibrating loose from the terminals 114, 116 in the PTCR/OL 102 during operation of the equipment. As can be seen in FIG. 2, there are relatively deep wells 110, 112 that are used to insulate and isolate each of the lead wires 104, 106 and terminals 114, 116 in the PTCR/OL 102, onto which the positive and negative locking mechanisms 104*a*, 106*a* are connected. The locking mechanisms 104*a*, 106*a* must be properly oriented in the wells 110, 112, to be connected to the terminals. This orientation can be difficult to determine given the relative depth of the wells, which are required to electrically isolate the connections. Additionally, a special tool or small screwdriver must be inserted into the wells 110, 112 to actually connect or disconnect the locking mechanisms 104*a*, 106*a* from the terminals 114, 116 in the wells 110, 112 in order to remove or replace the device. This process is often complicated by confined physical locations of equipment and the position of the PTCR/OL assembly 100 on the equipment. Often, the size and bulk of the capacitor 108 makes access to the wells 110, 112 difficult, depending on the orientation of the PTCR/OL assembly 100 in situ.

Figure 3:
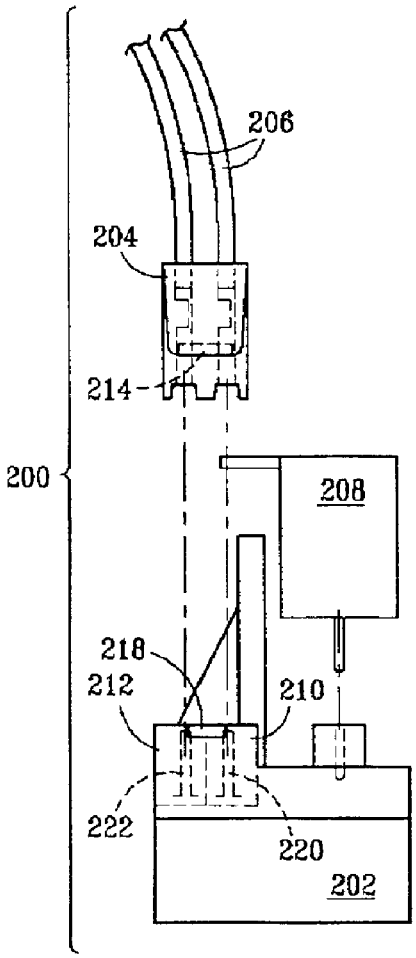
FIG. 3 is a partially exploded view of a PTCR/OL assembly embodying features of one arrangement of the present invention.

In FIG. 3, one embodiment of the present invention is shown which permits easy electrical connection or disconnection of the PTCR/OL assembly without the need for special tools. The reference numeral 200 generally designates a PTCR/OL assembly embodying features of the present invention. The PTCR/OL assembly 200 comprises a PTCR/OL 202, and an electrical connection. Some arrangements of the PTCR/OL assembly 200 also comprise a plug-in run capacitor 208. In the arrangement of the present invention shown in FIG. 3, the electrical connection comprises a locking-tab electrical plug 204 with lead wires 206 attached thereto. The plug 204 depicted in FIG. 3 is a commercially available plug comprising female connections into which the lead wires 206 are attached to make a secure electrical connection, female terminals for securing to the male electrical terminals on the PTCR/OL 202, and an inward-facing locking tab 214 on an attached, flexible arm that snaps in place and locks under an angle 218 on cover 216 of the PTCR/OL 202. It is understood that other types of commercially available plugs 204 can also be used with the PTCR/OL assembly 200 of the present invention. The PTCR/OL 202 has sockets 210, 212 into which the electrical plug 204 is inserted. Each socket 210, 212 contains a knife-blade type male electrical terminal 220, 222 onto which the female terminals of the plug 204 are connected. Because the plug 204 offers isolation of each of the wires 206, the deep wells 110, 112 required for isolation of individual wires 104, 106 in the prior art are no longer necessary. Therefore, the sockets 210, 212 of the present invention are much shallower than the wells used in the prior art.

Figure 4:
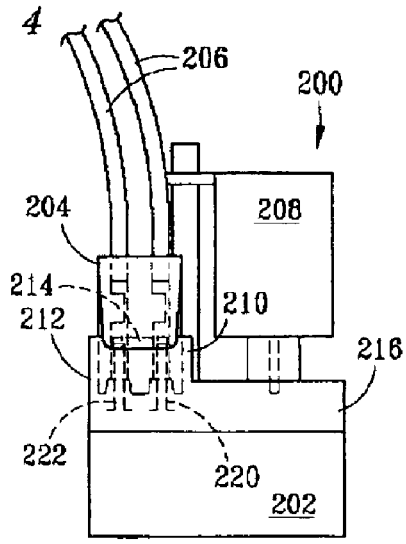
FIG. 4 is an assembled view of a PTCR/OL assembly embodying features of one arrangement of the present invention.
Figure 5:
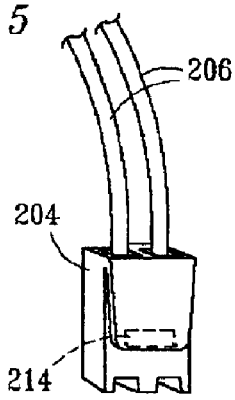
FIG. 5 is a detailed view of a locking tab plug of one arrangement of the present invention.

As can be clearly seen in FIGS. 4 and 5, the size of the electrical plug 204 in one embodiment of the present invention is such that when the plug 204 is secured into the sockets 210, 212 on the PTCR/OL 202, the locking tab 214 on the plug 204 rests under and against the angle 218 that projects from the side of the PTCR/OL 202, as shown in FIG. 3. Because the arm on which the locking tab 214 is located is relatively thin, when the plug 204 is snapped in place, the arm flexes enough that the locking tab slides across the upper surface and along the side of the angle 218 on the PTCR/OL 202, and snaps in place against the underside of the angle 218. This secures the plug 204 onto the terminals 220, 222 on the PTCR/OL 202 such that the plug 204 will not vibrate loose from the PTCR/OL 202 during operation of the equipment on which the PTCR/OL assembly 200 is installed.

When it is desired to electrically disconnect the PTCR/OL assembly 200 from the equipment, the locking tab 214 can be unlocked by flexing the arm into which the locking tab 214 is incorporated until the locking tab 214 is released from under the angle 218 on the PTCR/OL 202. By pulling the plug 204 fully away from the PTCR/OL 202, the electrical connection can be disconnected. In order to electrically reconnect the PTCR/OL assembly 200 to the equipment, the plug 204 should be aligned with the sockets 210, 212, and the locking tab 214 aligned with the angle 218 on the PTCR/OL 202. The plug 204 should be pushed into the sockets 210, 212 until the locking tab 214 snaps into place under the angle 218 and the female connections on the plug 204 are securely connected to the terminals 220, 222 on the PTCR/OL 202. In addition to requiring only a single step, no special tools are required to electrically connect or disconnect the plug 204 and attached wires 206 from the PTCR/OL 202. Also, because deep wells are not required to ensure electrical isolation during operation due to the fact that the plug 204 offers an extra degree of electrical isolation not seen in the old individual wires 104, 106, less material is required to manufacture the PTCR/OL 202.

Figure 6:
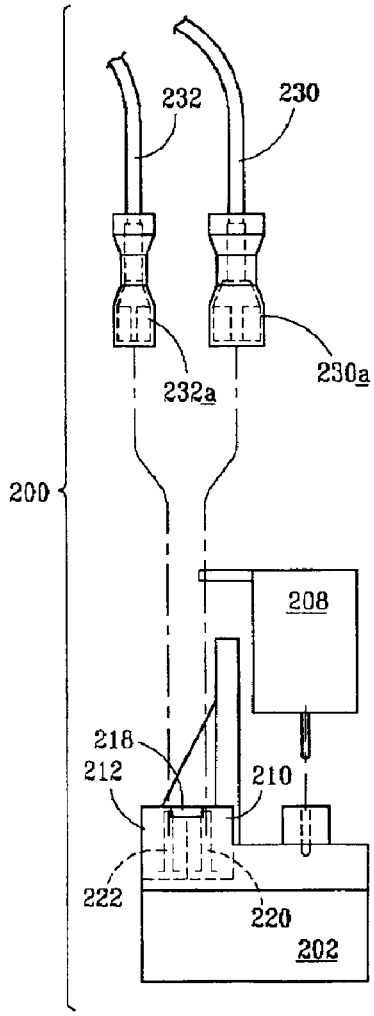
FIG. 6 is a partially exploded view of a PTCR/OL assembly embodying features of another arrangement of the present invention.
Figure 7:
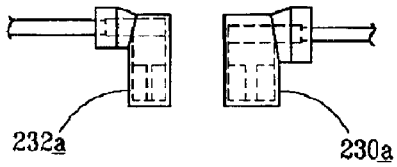
FIG. 7 is a detailed partially exploded view of an electrically isolated electrical plug of an arrangement of the present invention.

In another embodiment of the present invention shown in FIG. 6, the electrical connection comprises individual isolated electrical plugs 230*a*, 232*a* with lead wires 230, 232 attached thereto. The isolated electrical plugs 230*a*, 232*a* depicted in FIG. 6 are commercially available electrically isolated plugs comprising female connections into which the lead wires are attached to make a secure electrical connection. The PTCR/OL 202 has sockets 210, 212 into which the isolated plugs 230*a*, 232*a* are inserted. Each socket 210, 212 contains a knife-blade type male electrical terminal 220, 222 onto which the female terminals of the isolated electrical plugs 230*a*, 232*a* are connected. Typically, to prevent the possibility of incorrect electrical connection, terminal 220 and electrical plug 230*a* for the lead wire 230 are of a different size and/or shape than terminal 222 and electrical plug 232*a* for the neutral wire 232. Because the plugs 230*a*, 232*a* of the present invention offer isolation of each of the wires 230, 232, the deep wells 110, 112 required for isolation of individual wires 104, 106 in the prior art are no longer necessary. Therefore, the sockets 210, 212 of the present invention are much shallower than the sockets used in the prior art. Many varieties of electrically isolated plugs are commercially available. FIG. 7 shows another of the many types of isolated electrical plugs 230*a*, 232*a* that can be used in the PTCR/OL assembly 200 of the present invention.

Figure 8:
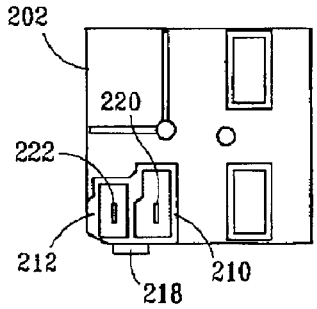
FIG. 8 is a top view of a PTCR/OL device of one arrangement of the present invention.

As can be seen in more detail in FIG. 8, the angle 218 is located adjacent to the sockets 210, 212 on the PTCR/OL 202, and projects beyond the body of the PTCR/OL 202. When the PTCR/OL 202 is connected to individual isolated electrical plugs, 230*a*, 232*a*, rather than a plug 204 utilizing a locking tab 214, the angle 218 may not be used, but is of a size and location so as to not interfere with the connection of the plugs 230*a*, 232*a*. In one arrangement of the present invention, as shown in FIG. 8, the sockets 210, 212 on the PTCR/OL 202 are preferably not the same size as each other to further inhibit connecting the plug 204 or isolated electrical plugs 230*a*, 232*a* to the PTCR/OL 202 with an improper electrical orientation. This prevents any improper orientation of the wires, or reversal of the circuits, which could cause possible shorts or failures of the PTCR/OL assembly 200 or the device to which it is attached.

Figure 9:
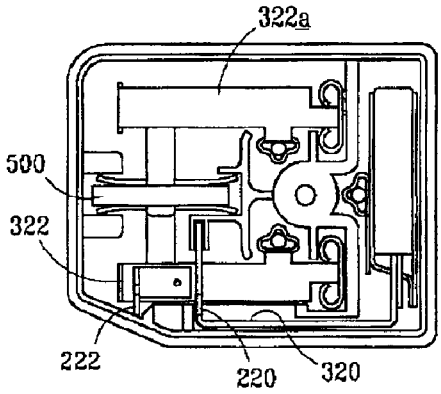
FIG. 9 is a top view of one arrangement of a PTCR/OL of the present invention with the cover removed, showing part of the mechanism of the present invention, including the terminals, plate, and pressure plates.

As shown in FIG. 9, the cover 216 of the PTCR/OL 202 of the present invention has been removed. The terminals 220, 222 must be configured so that they project through the sockets 210, 212 in the cover 216 of the PTCR/OL 202, as shown in FIG. 8. The lead terminal 220 must also be configured to connect to the plate 320 inside the PTCR/OL 202. The neutral terminal 222 must be configured to connect to pressure plate 322 inside the PTCR/OL 202. The pressure plate 322 connected to the neutral terminal 222 is configured to form a holder, along with an identical pressure plate 322*a* for the positive temperature coefficient (PTC) sensor 500. Because the same pressure plate can be used for two parts within the PTCR/OL 202, the number of parts to be manufactured, inspected and stocked for replacements is greatly reduced.

Figure 10:
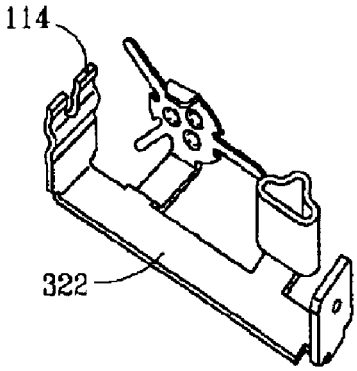
FIG. 10 (PRIOR ART)
FIG. 10 is a perspective view of the neutral terminal and pressure plate of the prior art.

The single piece pressure plate 322 and neutral terminal 114 used in the prior art is shown in detail in FIG. 10. However, the present invention utilizes a single PTCR/OL 200 that has neutral connection terminals 222 of varying shapes and sizes, depending on the particular arrangement used. One method of doing this is to make different plates 322 for each arrangement of PTCR/OL 200 developed. However, to reduce the cost and number of parts that must be manufactured, inspected and stocked, it was determined that it would be desirable to develop a single pressure plate 322 to which a variety of different types of connection terminals 222 could be attached. This was especially practical for the neutral terminal pressure plate 322, because it already served a dual purpose as it existed in the PTCR/OL 200 to form the holder for the PTC sensor 500 when used with second pressure plate 322*a*, and would have to continue to be manufactured in its present form. If the same pressure plate 322 could be used in the present invention with a variety of electrical connection terminals 222 without necessitating extensive rework, great savings in cost and efficiency could be recognized.

Figure 11:
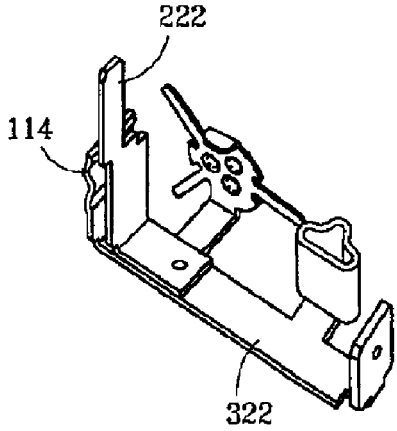
FIG. 11 is a perspective view of the neutral terminal and pressure plate of the prior art modified for use with the present invention.
Figure 12:
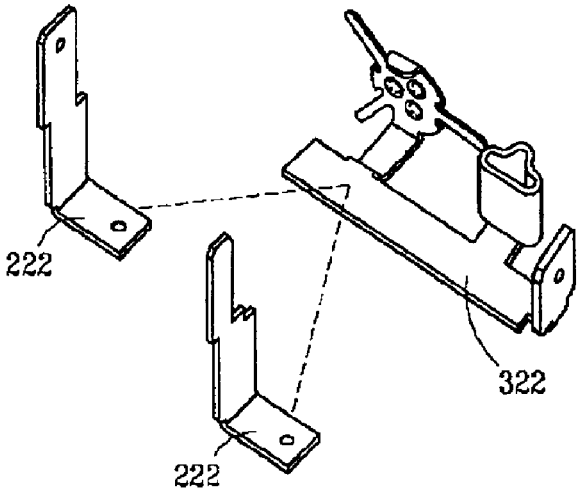
FIG. 12 is an exploded view of some arrangements of the neutral terminals and pressure plate of the present invention.

As shown in FIG. 11, a part usable in the present invention can be achieved by welding, soldering or otherwise attaching an electrical connection terminal 222 to the existing pressure plate 322. The terminal 114 used in the prior art PTCR/OL 100 can be cut off before or after attaching the new terminal 222 to the pressure plate 322. However, because the PTCR/OL 200 of the present invention has sockets 210, 212, which are in slightly different positions than the wells 110, 112 of the prior art PTCR/OL 100, in most cases it is not necessary to cut off the terminal 114 used in the prior art PTCR/OL 100. Because the terminal 222 is made separately and then attached to the pressure plate 322, it can be made in a variety of different sizes, or of different conductive materials than the pressure plate 322. FIG. 12 shows a pressure plate 322 and different shapes of terminals 222 which can be attached to the pressure plate 322, depending on the application for which the PTCR/OL 200 will be used, and the electrical connection methods that will be employed. FIG. 12 depicts a pressure plate 322 from which the prior art terminal 114 has been removed.

It is understood that the present invention can take many forms and embodiments. Having described the present invention by reference to certain of its preferred embodiments, it is noted that the embodiments disclosed are illustrative rather than limiting in nature and that a wide range of variations, modifications, changes, and substitutions are contemplated in the foregoing disclosure and, in some instances, some features of the present invention may be employed without a corresponding use of the other features. Many such variations and modifications may be considered obvious and desirable by those skilled in the art based upon a review of the foregoing description of preferred embodiments. Accordingly, it is appropriate that the appended claims be construed broadly and in a manner consistent with the scope of the invention.

What is claimed is:

1. A positive temperature coefficient of resistance current limiting assembly adapted for connecting to both nonlocking-type electrically isolated plugs and lockable-type electrically isolated plugs, comprising:

a positive temperature coefficient of resistance current limiting device having a body having a top, at least two adjacent sockets each having upstanding walls and at least one male terminal therein, a capacitor disposed on said top and a positive temperature coefficient of resistance resistor, at least one male conductive terminal in each of the at least two adjacent sockets, each of said male terminals being at least configured to receive a female conductive connection element on an electrically isolated plug, one of said two sockets having an interior cross-sectional size or shape that is different from the interior cross-sectional size or shape of the other socket and at least one of said sockets further being asymmetrical to facilitate connection of a cooperatively-shaped electrically isolated plug in only the proper orientation, and an engageable member disposed on an upstanding wall of at least one of said sockets and outside of said sockets such that it will not interfere with insertion of a single-conductor electrically isolated plug into either of said sockets, the engageable member further being positioned so its middle is disposed generally between lines extending axially through said male terminals when viewed from the side but offset to the side of a line extending between said male terminals when viewed from above, said engageable member further having a lower edge adapted to lockably engage a locking tab of a lockable electrically isolated plug when a lockable electrically isolated plug is inserted into said sockets.

2. The assembly of claim 1, wherein the capacitor has at least one male connector and there is at least one female receptacle on the positive temperature coefficient of resistance current limiting device for receiving the at least one male connector of the capacitor.

3. The assembly of claim 1 wherein the electrically isolated plug further comprises a flexible arm with a locking tab of a size and shape such that the upper surface of the locking tab can be retainingly secured against the underside of the engagement member.

4. The assembly of claim 3 wherein the flexible arm can be flexed so as to release the locking tab from pressing up against the underside of the engagement member.

5. The assembly of claim 1, wherein the male connection terminal in the socket on the positive temperature coefficient of resistance current limiting device is electrically isolated from adjoining conductive parts.

6. The assembly of claim 1, wherein each of the at least two adjacent sockets on the positive temperature coefficient of resistance current limiting device are of a different size to fit different size plugs to facilitate connection of the correct plug to the correct male conductive terminal.

7. The assembly of claim 1, wherein the male conductive terminal is attached to at least one plate made of conductive material.

8. The assembly of claim 1, wherein the male conductive terminal is attached to at least one plate made of conductive material by means of welding.

9. The assembly of claim 1, wherein the male conductive terminal is attached to at least one plate made of conductive material by means of soldering.

10. The assembly of claim 1 wherein said at least one male conductive terminal is attached to a portion of a plate from which a previously existing male conductive terminal has been cuttingly removed.

11. The assembly of claim 1 wherein there is at least one upstanding wall disposed between said two male terminals.

12. The assembly of claim 11 wherein said at least one upstanding wall is shared by both sockets.

* * * * *